United States Patent [19]

Paiste, Sr. et al.

[11] Patent Number: 4,809,581

[45] Date of Patent: Mar. 7, 1989

[54] CYMBAL

[75] Inventors: Robert Paiste, Sr., Nottwil; Lothar Bangert, Dornach, both of Switzerland

[73] Assignee: Paiste AG, Nottwil, Switzerland

[21] Appl. No.: 220,815

[22] Filed: Jul. 13, 1988

[30] Foreign Application Priority Data

Jul. 24, 1987 [CH] Switzerland ..... 02832/87

[51] Int. Cl.[4] ..... G10D 13/06

[52] U.S. Cl. ..... 84/402

[58] Field of Search ..... 84/402, 422

[56] References Cited

U.S. PATENT DOCUMENTS

| | | | |
|---|---|---|---|
| 3,546,994 | 12/1970 | Paiste | 84/402 |
| 3,640,029 | 2/1972 | Zildjian | 51/322 |
| 4,677,892 | 7/1987 | Kramer et al. | 84/405 |

*Primary Examiner*—Lawrence R. Franklin

*Attorney, Agent, or Firm*—Werner W. Kleeman

[57] ABSTRACT

A cymbal made of bronze which contains primarily copper and tin. Tin is present in the range of 13 to 18 percent by weight. This cymbal permits an advance into a totally new sound dimension or sound effects.

11 Claims, 1 Drawing Sheet

CYMBAL

BACKGROUND OF THE INVENTION

The present invention broadly relates to a percussion instrument and, more specifically, to a new and improved construction of a cymbal.

In its more particular aspects the present invention relates to a new and improved construction of a cymbal made of a bronze which contains primarily copper and a comparatively smaller proportion or content of tin.

Cymbals generally possess a central dome or cup which contains a hole at the zenith or uppermost part thereof for the mounting or suspension of the cymbal. An umbrella-like annular zone or region extends from this central dome or cup to the margin or edge of the cymbal.

There are also known variant constructions having a modified dome and others without a dome, as well as many different constructions of the shape or form of the cymbal itself which however are of less importance.

In any case, the quality of a cymbal, and such is the case to an appreciable extent, is also predicated upon the care with which it is fabricated, for example, by shaping or forming. Shaping by cold-hammering, at least in the final phase of the profiling or shaping process, can be of importance. This cold-hammering or another shaping or forming operation can be followed, if desired or necessary, by surface finishing by a lathe or other turning work, preservative treatment, coloring and the like.

Therefore, for centuries all efforts made for improving the quality and for obtaining another sound or tone concentrated upon altering the shaping or forming process and the cymbal form itself.

However, during these centuries one has steadfastly adhered to using bronze with a tin content of 20 percent by weight which was recognized and accepted as proper and suitable for cymbals.

Less than three decades ago experiments were carried out for economical considerations with a commercial common bronze sheet or plating containing 8 percent tin by weight. The result was that the old bronze rule was confirmed and proven to be correct. One had to realize that with careful working and processing of the cymbal it was possible to achieve considerable qualitative results with the bronze sheet or plating containing 8 percent by weight tin, but these results could never approach the results obtained with traditional cymbals having a tin content of 20 percent by weight.

Experiments subsequently performed with sheet bronze that contained 12 percent by weight tin resulted in a further confirmation of the traditional theory. Ultimately, these cymbals with a tin content of 12 percent by weight remained unsuccessful.

Consequently, there appeared to be no way to depart from the traditional rule when certain requirements were imposed upon the sound or tone to be produced by the cymbal.

SUMMARY OF THE INVENTION

Therefore, with the foregoing in mind, it is a primary object of the present invention to provide a new and improved construction of cymbal which permits an advance into a totally new sound dimension.

Another important object of the present invention concerns the provision of a new and improved construction of cymbal which departs from traditional cymbal design theory and results in a cymbal producing enhanced sounds or tones.

Now in order to implement these and still further objects of the invention, which will become more readily apparent as the description proceeds, the cymbal of the present development is manifested by the feature that the cymbal contains a tin content in the range of 13 to 18 percent by weight.

Despite the earlier disappointments, recently carried out experiments have surprisingly demonstrated that cymbals containing tin in the range of 13 to 18 percent by weight, particularly a tin content of 14 to 16 percent by weight, advance into a totally new sound dimension.

Preferably, as stated, the tin content is in the range of 14 to 16 percent by weight and the best results so far were achieved with a tin content in the range of 14.7 to 15.8 percent by weight and preferably in the range of 14.7 to 15.1 percent by weight. Good results were also obtained in the range of 14.5 to 15.5 percent by weight and preferably 14.5 to 15.1 percent by weight.

A phosphorus content of at most 0.1 percent by weight for the tin bronze has proven to be advantageous.

Very good results have been obtained when in the course of the forming or shaping process the domeless circular blanks or discs or the blanks already provided with a dome or cup are hammered, particularly cold-hammered.

The blanks or discs are preferably fabricated from a sheet, particularly a cold rolled sheet or plating.

According to a further feature of the invention it has been found that cymbals formed of a material having a grain size in the range of 3 to 15 micrometers, whether such be in the sheet or plating before the blanks or discs are cut out or in the finish-hammered condition, have proven to be excellent.

Cymbals fabricated according to the invention which have a hardness in the range of 150 to 250 kiloponds per square millimeter, depending upon the desired sound or tone, are excellent.

Now as before the processing as well as the shape or form certainly play a role. But when traditional cymbals and cymbals with a tin content of 8 percent by weight, on the one hand, are compared with cymbals produced according to the invention, on the other hand, wherein the cymbals are processed or worked as well as formed in the same manner, the excursion of the inventive cymbals into a totally new sound dimension becomes clearly apparent.

The following explanation is naturally based upon a very individual artistic perception, which in itself is nonetheless suitable to differentiate the greatness and significance in the aesthetics of sounds produced with the inventive cymbal from the relatively simple and unpretentious sounds produced with heretofore known cymbal constructions. There still have not been found any adequate absolute technical measuring methods for such sound comparisons.

In this sense the cymbal according to the present invention has a denser or fuller sound spectrum with an almost uninterrupted transition from high to low pitches.

The cymbal is dominant in the entire frequency range without emphasizing individual frequencies.

The sound mixture is balanced in the entire range between coarse and fine tones.

The cymbal reacts very directly in sound volume.

The cymbal is delicate when gently played. It quickly responds.

The cymbal is very voluminous when loudly played.

The cymbal in its sound is both earthy and transparent.

Apart from combining the good qualities and characteristics of a cymbal containing 20 percent by weight tin and a cymbal containing 8 percent by weight tin, the inventive cymbal additionally has silvery sound peaks.

There is so-to-speak more volume present. The sound is broader, more balanced, more resonant and more compact.

In other words and in summation: there is, as previously noted, a new sound dimension.

BRIEF DESCRIPTION OF THE DRAWING

The invention will be better understood and objects other than those set forth above will become apparent when consideration is given to the following detailed description thereof. Such description makes reference to the annexed drawing wherein.

DETAILED DESCRIPTION OF THE PREFERRED EMBODIMENTS

Figure 1:
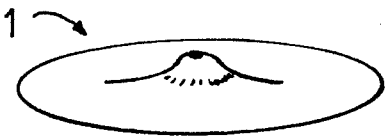
FIG. 1 is a schematic perspective illustration of a cymbal on a reduced scale.

Describing now the drawing, it is to be understood that only enough of the construction of the cymbal has been shown as needed for those skilled in the art to readily understand the underlying principles and concepts of the present development while simplifying the showing of the drawings. Turning now specifically to FIG. 1, there has been purely schematically illustrated therein a schematic perspective view of a cymbal 1 which possesses the most widely used cymbal shape or form.

Figure 2:
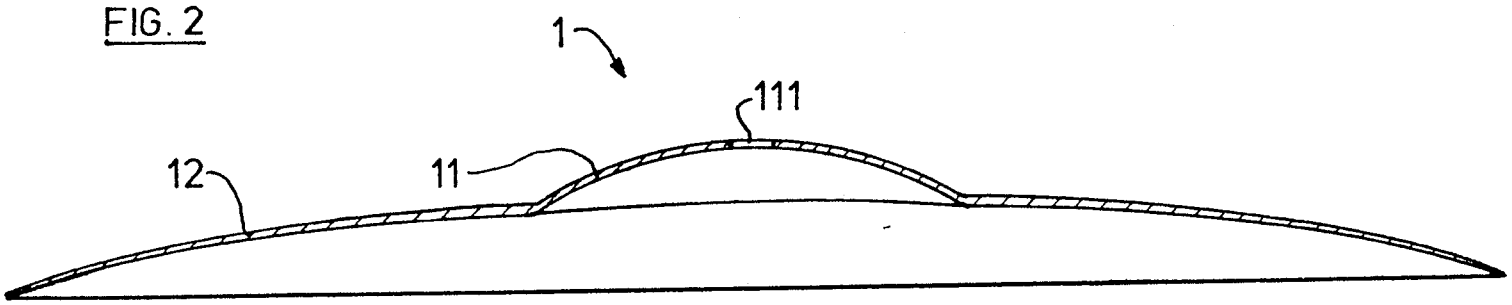
FIG. 2 is a transverse section through the cymbal shown in FIG. 1 and taken perpendicular through the highest point or zenith of the dome or cup and shown on a larger scale than in FIG. 1.

As will be recognized from the illustration of FIG. 2, the cymbal 1 comprises a central dome or cup 11 and an umbrella-like arched annular zone 12 which surrounds the central dome or cup 11.

At the zenith or highest point of the central dome or cup 11 there is located a hole or aperture 111 which can serve for the suspension or mounting of the cymbal 1, for instance at a non-illustrated but conventional stand.

The material or special alloy for the inventive cymbal 1 can be processed, by way of example and not limitation, as hereinafter disclosed:

An alloy containing, for example, 14.7 percent by weight tin, 0.08 percent by weight phosphorus and 85.22 percent by weight copper is initially melted in an induction melting furnace.

The melt is delivered at a temperature of 1000° C. to 1200° C. into a heat retention or holding furnace of a strip or band casting installation. A strip or band is cast.

The cast strip or band has, for example, a width of 670 mm and a thickness of 18 mm. This strip or band cannot be coiled and is therefore cut into plates of approximately 3 to 4 meters length.

Such plates are now homogenized at 600° C. to 700° C. during about 10 to 25 hours.

Then the casting and oxidation skin is removed by means of a milling tool or cutter or equivalent structure.

Thereafter the plates are initially only slightly cold rolled, i.e. by about 20 percent and then recrystallized at temperatures between 500° C. and 700° C. This process cycle of cold rolling and recrystallization takes place until a final sheet or plate thickness of 1 to 2 mm is obtained.

Then a final annealing is carried out at temperatures between 400° C. and 500° C.

The obtained grain size then should be between 0.003 and 0.015 mm.

The hardness should lie between 150 250 kiloponds per square millimeter, depending on the strived for sound or tone character.

Now circular blanks or discs of, for example, 200 to 610 mm in diameter are cut out of this sheet or plate from which there is formed the aforedescribed cymbal 1.

The cymbal 1 shown by way of example in FIG. 1 and described with reference thereto can be fabricated as follows:

The dome or cup 11 is formed at the corresponding blank or disc heretofore described by pressing, die stamping, drawing or in any other suitable manner.

The hole or aperture 111 is drilled into the zenith or apex of the dome or cup 11.

Further forming or shaping is carried out by hammering the cold material.

The thus formed or shaped cymbal is superficially faced or surface finished, preferably by hand, and then provided with a suitable conservation or preserving layer or film.

In comparison with a traditional cymbal formed or shaped in analogous manner the inventive cymbal renders possible a totally new sound dimension.

While there are shown and described present preferred embodiments of the invention, it is to be distinctly understood that the invention is not limited thereto, but may be otherwise variously embodied and practiced within the scope of the following claims.

Accordingly, what we claim is:

1. A cymbal comprising:

a bronze containing primarily copper and a comparatively smaller proportion of tin; and said tin being present in a tin content in the range of 13 to 18 percent by weight.

2. The cymbal as defined in claim 1, wherein:

said tin content is in the range of 14 to 16 percent by weight.

3. The cymbal as defined in claim 1, wherein:

said tin content is in the range of 14.5 to 15.5 percent by weight.

4. The cymbal as defined in claim 1, wherein:

said tin content is in the range of 14.7 to 15.8 percent by weight.

5. The cymbal as defined in claim 1, further including:

phosphorus in a content of less than 0.1 percent by weight.

6. The cymbal as defined in claim 1, wherein:

said cymbal comprises a hammered material.

7. The cymbal as defined in claim 1, wherein:

said cymbal comprises a cold hammered material.

8. The cymbal as defined in claim 1, wherein:

said cymbal is made of sheet metal.

9. The cymbal as defined in claim 1, wherein:

said cymbal is made of cold rolled sheet metal.

10. The cymbal as defined in claim 1, wherein:

said cymbal possesses a grain size in the range of 3 to 15 micrometers.

11. The cymbal as defined in claim 1, wherein:

said cymbal possesses a hardness in the range of 150 to 250 kiloponds per square millimeter.

* * * * *